United States Patent [19]

Werner

[11] 4,050,490

[45] Sept. 27, 1977

[54] METHOD FOR FABRICATING A LAMP AND SHADE

[76] Inventor: Harvey Albert Werner, 6531 Kessler Ave., Woodland Hills, Calif. 91364

[21] Appl. No.: 695,965

[22] Filed: June 14, 1976

[51] Int. Cl.[2] ..... B27D 1/10

[52] U.S. Cl. ..... 144/316; 144/309 A; 144/314 R; 144/323; 156/250; 156/264

[58] Field of Search ..... 156/256, 264, 250; 144/309 A, 309 R, 314 R, 314 A, 314 B, 315 R, 315 A, 321, 322, 323, 326 R, 134 R

[56] References Cited

U.S. PATENT DOCUMENTS 1,567,390 12/1975 Ruppert ..... 144/316 R

*Primary Examiner*—Othell M. Simpson
*Assistant Examiner*—W. D. Bray
*Attorney, Agent, or Firm*—Craig O. Malin

[57] ABSTRACT

A method of fabricating a lamp, wherein the lamp base is made by providing a polyhedral block of wood and cutting the vertical plane faces of the block to form vertically curved sides while still maintaining the straight shape of the faces in the horizontal direction. The lamp shade is made from a plurality of nestable curved panels that are cut from a rectangular parallelepiped block. The panels are placed on a multi-faced form and their vertical edges are joined together to form the shade.

5 Claims, 5 Drawing Figures

METHOD FOR FABRICATING A LAMP AND SHADE

BACKGROUND OF THE INVENTION

This invention relates to the field of furniture, particularly to lamps.

A wide variety of lamps have been created in the prior art to meet the many demands of interior decorators. These prior art lamps generally have ceramic or metal bases and fibre shades. Occasionally, expensive hand carved wood is used for the base of the lamp. However, most often, the wooden base is turned on a lathe which always results in a base having a circular cross section. Thus, these wooden lamps tend to have a monotonous similarity in appearance.

Many people like the beauty and natural look of wood, and these people are continuously looking for distinctive wooden furniture. The prior art lathe-turned wooden lamp bases with their cloth shades severely limit the choice available in this highly selective market.

Therefore, there exists a continuing need for distinctive lamps of obviously high quality and novelty.

SUMMARY OF THE INVENTION

It is an objective of the invention to provide a method of making a distinctive lamp of obvious high quality.

It is a further object of the invention to provide a method of making a lamp base of predominantly wooden construction which is unique in shape from prior art wooden lamp bases.

It is a further objective of the invention to provide a method of making a wooden lamp base and a lamp shade which compliments the base in material and design.

According to the invention, the base is made by providing a polyhedral block of wood and cutting the vertical plane faces of the block to form vertically curved sides while still maintaining the straight shape of the faces in the horizontal direction. The lamp shade is fabricated from a plurality of nestable curved panels that are cut from a rectangular parallelepiped block. The panels are placed on a multi-faced from and their vertical edges are joined together to form the shade.

BRIEF DESCRIPTION OF THE DRAWINGS

The invention will now be described in detail with reference to the accompanying drawings representing preferred embodiments of the lamp according to the present invention. In the drawings.

DESCRIPTION OF THE PREFERRED EMBODIMENTS

Figure 1:
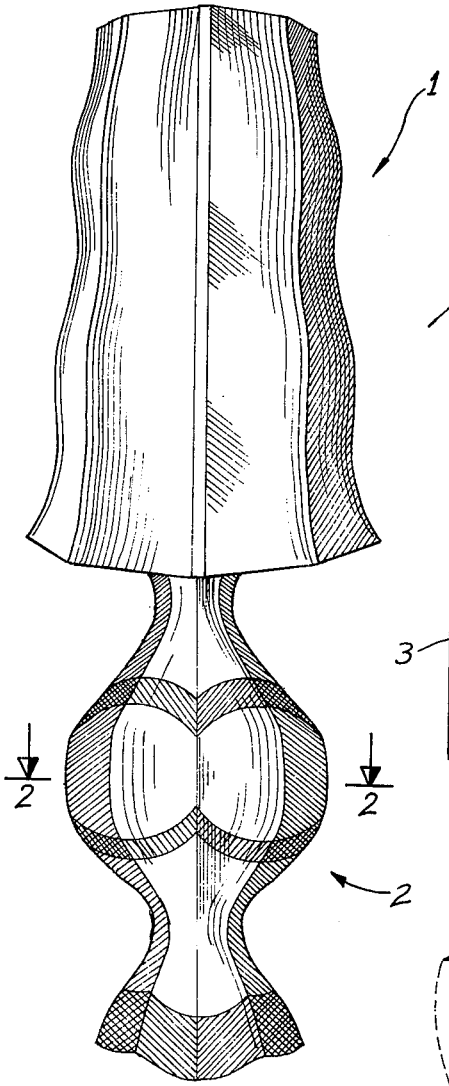
FIG. 1 is a perspective view of the lamp.

FIG. 1 is a perspective view of the lamp assembly showing the shade 1 and base 2. In the vertical direction, the faces of both the base and shade are gently curving. However, in the horizontal direction the faces are straight, as best shown by the dotted line 4 in FIG. 2. This type of configuration can not be duplicated on a lathe because rotation of the part in the lathe results in a circular cross-section.

Figure 2:
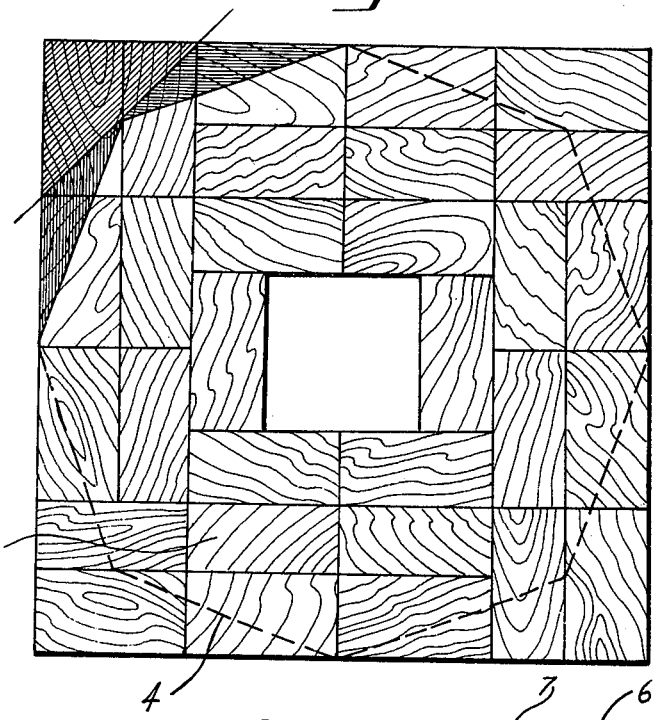
FIG. 2 is a cross-section of the lamp base at 2—2 of FIG. 1 showing how the cross-section is formed from a square block of wood.

FIG. 2 shows a preferred method of fabricating base 2. Boards 3 approximately 1½ inches thick and as long as the height of the base are bonded together to form a square cross section. As shown, boards can be omitted from the center to provide a center hole for the electrical wiring of the lamp. Each corner of the square is cut off for a distance of one-fourth of each side as shown by the lightly shaded area. Two further cuts are made as shown by the darkly shaded areas to form an octagonal cross-section extending the entire length of the block.

The size of the octagonal cross-section is then varied along the height of the block by cutting into the faces to create a curved surface in the vertical directions as shown in FIG. 1. However, the octagonal cross-section with straight sides is maintained throughout the entire length of the base. Further, the intersections of the octagonal faces are maintained in a vertical plane. The result is a mixture of curved and straight lines which provide a pleasing appearance suprisingly different from the usual lathe-turned wood construction.

Further adding to the pleasing, natural wood appearance is the curved end grain formed on the face of the base as a result of the mosaic construction, as shown in FIG. 1.

Figure 3:
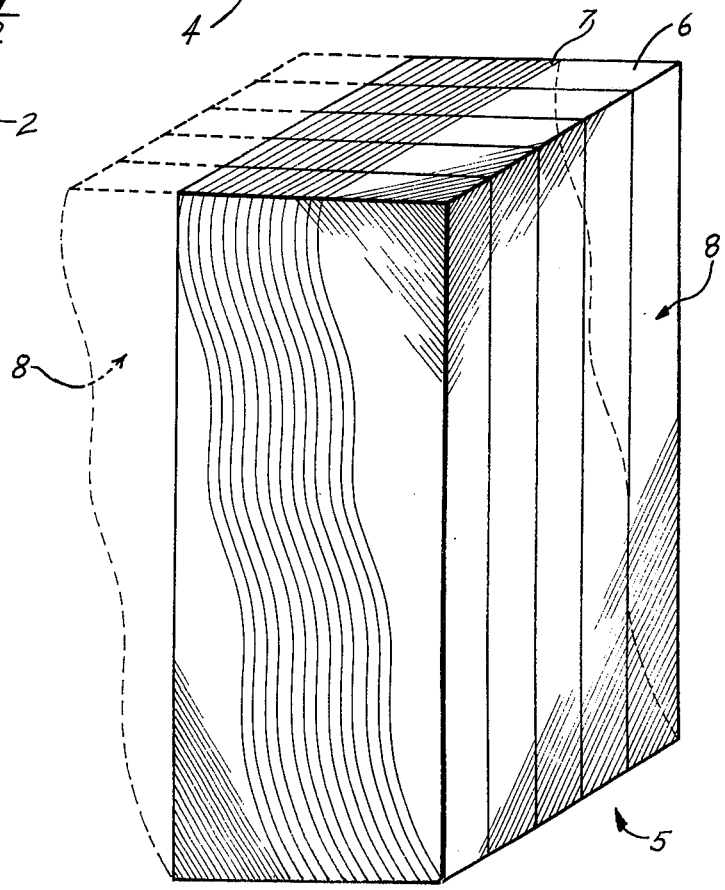
FIG. 3 is a perspective view of a block of wood showing how the shade panels are cut.

FIG. 3 shows a preferred method of fabricating the curved panels which are used to construct the lamp shade. A block 5 in the shape of a rectangular parallelepiped 30 inch × 10 inch × 10 inch is built by bonding together 1½ × 10 inch × 10 inch wooden planks 6. The block is placed on the horizontal table of a band saw and individual panels 7 are cut from the block. It is preferred that these panels be quite thin, for example one-fourth inch thick, and a band saw having an extra large table is required to accurately position the large block during the full length of the cut.

Since the panels 7 are nestable, there is very little waste of material. Further economy of material is obtained by taking portion 8 cut from the block and gluing its front face to the back side of block 5 as shown by the dotted lines in FIG. 3. In this manner the entire block (except for the saw cuts) can be used to fabricate the lamp panels.

The panels 7 in the vertical direction are gently curving and are straight in the horizontal direction. Thus the shade compliments the base in both its wooden construction and general configuration.

Figure 4:
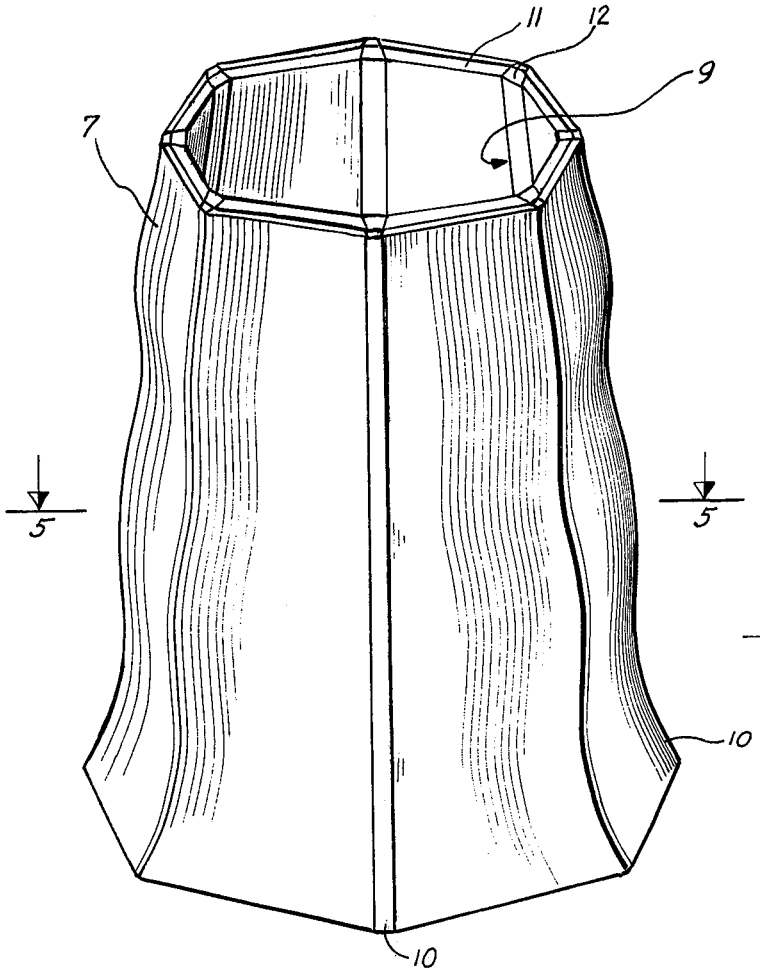
FIG. 4 is a perspective view of the panels of the lamp shade as placed on the multi-faced form.
Figure 5:
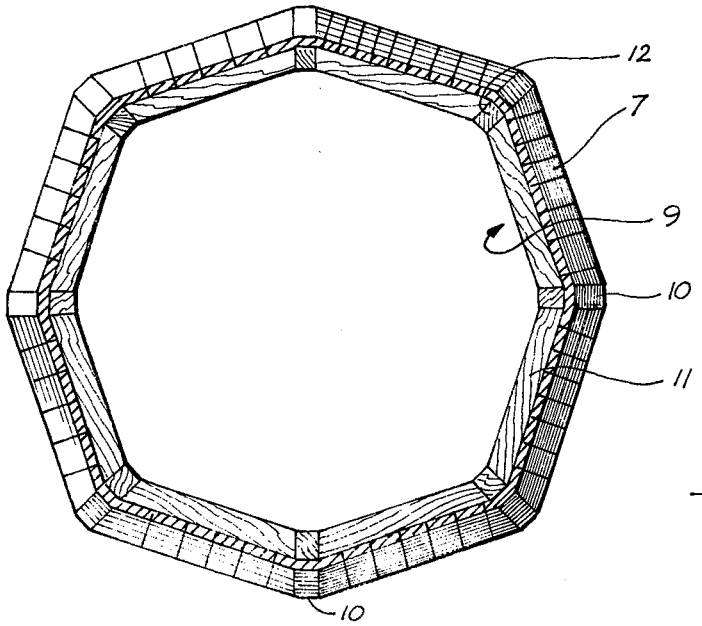
FIG. 5 is a cross-section of the assembly at 5—5 of FIG. 4.

FIGS. 4 and 5 show the method used to join the individual panels 7 together to form the shade. A multi-faced form 9 having faces 11 is provided, against which the panels 7 are held. If the shade is to be tapered, the edges of the panels 7 are cut to make the panels narrower at the top than at the bottom.

In one embodiment, a narrow joining strip 10 is cut from an extra panel 7 to provide a transition between the panels 7. A pattern for this joining strip can be made by placing a paper between the panels 7 and cutting it to fit between the panels. This joining strip is held against a mating face 12 on the panel and all the panels and joining strips are glued together while being held against the form. After the glue has hardened, the shade is removed from the form and joined to the base using known techniques and available hardware.

From the foregoing, it can be realized that this invention can assume various embodiments. Thus, it is to be understood that the invention is not limited to the specific embodiments described herein, but is to be limited only by the appended claims.

What is claimed is:

1. A method for making a lamp shade comprising the steps of:

providing a rectangular parallelepiped block;

cutting a plurality of nestable curved panels of similar shape from said block, said panels having vertical edges and being curved in a vertical direction with straight top and bottom faces in a horizontal direction;

providing a multi-faced form;

placing one of said multi-faced form;

joining the vertical edges of said panels together to form the shade; and removing said form from said shade.

2. The method for making a lamp shade as claimed in claim 1, wherein said step of providing a block comprises: joining together rectangular boards.

3. The method for making a lamp shade as claimed in claim 1, including the steps of removing a portion of said block which is formed when the first of said panels is cut from said block and joining a front planar face of said portion to a back planar face of said block, whereby said portion can be used for cutting additional panels.

4. The method for making a lamp shade as claimed in claim 1, wherein said step of joining the vertical edges includes the steps of providing a narrow joining strip between mating pairs of said edges and bonding said joining strip to said mating pair of edges.

5. The method for making a lamp shade as claimed in claim 1, wherein said step of cutting a plurality of nestable curved panels comprises placing said block on the table of a band saw and using the band saw to cut said panels.

* * * * *